US005275154A

United States Patent [19]

Von Blücher et al.

[11] Patent Number: 5,275,154

[45] Date of Patent: Jan. 4, 1994

[54] ACTIVATED CHARCOAL FILTER LAYER FOR GAS MASKS

[76] Inventors: Hasso Von Blücher, Columbusstrasse 58, D-4000 Düsseldorf 1; Ernest de Ruiter, Höhenstrasse 57a, D-5090 Leverkusen 3, both of Fed. Rep. of Germany

[21] Appl. No.: 713,540

[22] Filed: Jun. 6, 1991

Related U.S. Application Data

[63] Continuation of Ser. No. 341,090, Apr. 20, 1989, abandoned.

[30] Foreign Application Priority Data

Apr. 22, 1988 [DE] Fed. Rep. of Germany ..... 3812562

[51] Int. Cl.[5] ..... A62B 7/10

[52] U.S. Cl. ..... 128/205.27; 128/205.28; 128/205.29

[58] Field of Search ..... 128/205.27, 205.28, 128/205.29, 26.15; 55/DIG.

[56] References Cited

U.S. PATENT DOCUMENTS

| | | | |
|---|---|---|---|
| 1,559,980 | 11/1925 | Perrott et al. | 55/DIG. 33 |
| 1,781,254 | 11/1930 | Stelzner | 55/DIG. 33 |
| 1,818,155 | 8/1931 | Oglesby et al. | 128/205.29 |
| 2,348,074 | 5/1944 | Lambertsen | 128/205.28 |
| 3,116,969 | 1/1964 | Coleman, Jr. | 128/205.29 |
| 3,381,454 | 5/1968 | Sponsel | 128/205.27 |
| 3,944,403 | 3/1976 | Simpson et al. | 128/206.17 |
| 4,011,067 | 3/1977 | Carey, Jr. | 128/205.29 |
| 4,064,876 | 12/1977 | Mulchi | 128/206.15 |
| 4,297,117 | 10/1981 | Holter et al. | 128/205.27 |
| 4,382,440 | 5/1983 | Kapp et al. | 128/205.28 |
| 4,386,948 | 6/1983 | Choksi et al. | 128/205.29 |
| 4,572,178 | 2/1986 | Takase et al. | 128/205.27 |
| 4,643,182 | 2/1987 | Klein | 128/201.25 |

FOREIGN PATENT DOCUMENTS

| | | |
|---|---|---|
| 0118618 | 9/1984 | European Pat. Off. . |
| 0159696 | 10/1985 | European Pat. Off. . |
| 0218348 | 4/1987 | European Pat. Off. . |
| 0294707 | 12/1988 | European Pat. Off. . |
| 635674 | 9/1936 | Fed. Rep. of Germany . |
| 3200959 | 7/1983 | Fed. Rep. of Germany . |
| 3443900 | 6/1986 | Fed. Rep. of Germany . |
| 896345 | 5/1962 | United Kingdom . |

*Primary Examiner*—Edgar S. Burr
*Assistant Examiner*—Aaron J. Lewis
*Attorney, Agent, or Firm*—Sprung Horn Kramer & Woods

[57] ABSTRACT

The activated charcoal filter layer for gas masks essentially is formed of superimposed, highly air-permeable surface structures with a layer of granular or spherical activated charcoal particles with a diameter of 0.1 to 1 mm affixed to them, and its pressure drop is less than 10 mm water column at a thickness of 4 cm with a circular cross-section of 100 $cm^2$ at an air flow of 1 1/sec.

22 Claims, No Drawings

ACTIVATED CHARCOAL FILTER LAYER FOR GAS MASKS

This application is a continuation of application Ser. No. 341,090, filed Apr. 20, 1989, now abandoned.

All conventional gas mask filters consist of a replaceable filter cartridge which contains at least one activated charcoal layer. Activated charcoal for gas mask filters usually has a specific or "internal" surface of 500 to more than 2000 $m^2/g$, determined according to the BET method. It is a particular feature of activated charcoal that it can permanently and very unspecifically adsorb a large number of substances in its micropores, which can comprise up to 50% of the total volume. Toxic gases, e.g. HCN, which are only weakly bound by the normal physical adsorption, can be bound using metal compounds, e.g. silver, copper or chromium compounds, which are applied, providing superimposed chemical sorption. The activated charcoal filter layer of gas mask filters is usually formed as a bulk filter, in which the medium to be purified flows through a fixed bed of the activated charcoal particles. In order to guarantee a sufficient period of functioning of the filter, a sufficient amount, i.e. mass of the adsorber material, must be present. At the same time, however, the adsorption kinetics are proportional to the available "external" surface of the particles, so that small particles are advantageous in this connection. In addition, larger activated charcoal particles can often be fully utilized only in their outer areas. These are usually already saturated—requiring an interruption and replacement of the filter cartridge—while the charcoal is only slightly charged on the inside. The use of the smallest possible particles in a bulk filter, however, necessarily leads to a high pressure drop. For practical purposes, the particle size is limited in a downward direction by the pressure drop related to it. A further disadvantage of bulk filters is that abrasion phenomena occur as a result of the activated charcoal particles rubbing against each other, and that the charcoal in powder form increases the flow resistance even more.

In general, the opinion is that good filter performance necessarily requires high flow-through resistance, because only then can there be good contact between the gas to be purified and the adsorber grains. In order to also preclude break-throughs across cavities which form when particles settle, the packing must be firmly compressed. In this way, high flow-through resistance of the activated charcoal bulk filters for gas masks is pre-programmed. But this not only results in the effect of physiological stress on the gas mask wearer, but also increases the feeling of constriction.

It is therefore the object of the present invention to create an activated charcoal filter layer for gas masks, i.e. a gas mask filter with low flow-through resistance and high adsorption performance.

The solution according to the invention is an activated charcoal filter layer for gas masks which essentially is formed of superimposed, highly air-permeable surface structures with a layer of granular or spherical activated charcoal particles with a diameter of 0.1 to 1 mm affixed to them, and the pressure drop of which is less than 10 mm, preferably less than 5, and especially less than 2 mm water column at a thickness of 4 cm with a circular cross-section of 100 $cm^2$ when an air flow of one liter per second flows through it.

Surface structures with granular or spherical activated charcoal particles affixed to them are known as so-called surface filters. They can be modified by a person skilled in the art, in accordance with the teaching of the present invention, in such a way that they result in an activated charcoal filter with the usual thickness for gas masks of several centimeters, by superimposing the necessary number of layers, covered with the required amount of granular or spherical activated charcoal particles, in a highly air-permeable manner.

Surface filters charged with microparticle substances with specific protective or adsorption properties, e.g. also surface filters charged with activated charcoal, particularly textile surface filters, are known. However, they have not been used for gas mask filters, because only activated charcoal bulk filters were considered suitable for this purpose, for the reasons stated above.

DE-B-28 04 154 describes a filter material consisting of an open-pore, flexible foam carrier and of adsorber particles carried by its pore walls. The adsorber grains can also be spherical and can consist of activated charcoal. Their size is significantly less, however, than that required for a surface filter from which a gas mask filter according to the invention could be produced.

DE-C-28 29 599 describes a multi-layer laminate material for protective clothing with a non-flammable woven textile as the outer layer, a mineral fiber layer and an inner layer of air-permeable heat-shielding polyurethane foam with a thickness of 2 mm, the pores of which are covered with activated charcoal particles, which consist at least in part of spherical, porous activated charcoal elements. In order for such a layer of polyurethane foam to be useful for the purposes of the invention, the foam would have to demonstrate a very open pore structure and these pores could not be covered with the activated charcoal particles. Rather, these would have to be affixed on the walls of the foam, in the proper size, in order to guarantee the high air permeability which surface filters require in order to result in a gas mask filter with the low pressure drop demanded, when they are superimposed on one another in a package.

DE-C-29 51 827 describes, among other things, a protective material against noxious chemicals and short-term heat action, which consists of an air-permeable, flexible carrier layer, i.e. a woven, fused, knit or nonwoven material, on which spherical adsorber grains with a diameter of approximately 0.1 to 0.7 are affixed on at least one side, on carrier columns of a solidified adhesive mass. Such a surface filter can be useful for the purposes of the invention, if granular or spherical activated charcoal is selected as the adsorption grains and the carrier layer is structured very loosely, e.g. as a lattice weave, and the activated charcoal beads are applied to both sides of the air-permeable carrier layer in the way described; for the purposes of the invention, this layer can certainly be produced of glass fibers or metallic fibers. In order to be usable as an activated charcoal filter layer for gas masks, such a surface filter also has to be highly air-permeable and be provided with the required amount of activated charcoal, so that it results in a gas mask filter with low flow-through resistance and high adsorption performance when the required number of layers are superimposed as a package.

The use of a flexible surface filter of DE-C-29 51 827, but with a carrier layer of foam or rubber hair, in an air cleaning device to remove smoke and pollutants in motor vehicle passenger areas, is the object of EP-B-100 907.

The same thing that was said above with regard to the material of DE-C-29 51 827 and making it usable for the purposes of the invention also applies to the material of EP-B-118 618, in which a surface filter made of an air-permeable textile carrier material and activated charcoal particles with a diameter of 0.1 to 1 mm, affixed to it with an adhesive, in uniform distribution, in that a hot-melt glue, a solvent-free polyurethane or a self-cross-linking acrylate is printed onto an air-permeable textile carrier material by means of a stencil, as a point-shaped or line-shaped pattern with a height of 0.05 to 0.5 mm and a diameter or a width of 0.2 to 1 mm, covering only 30 to 70% of the surface of the carrier material. Spherical activated charcoal is then fixed in this printed adhesive.

DE-A-32 00 959 discloses a textile surface filter made of a textile surface structure, e.g. a nonwoven, woven or plush material, which contains fibers which temporarily become sticky at elevated temperatures, without melting. These can be heterophilic fibers of two coaxially arranged components, the outer one of which demonstrates a lower melting point, or unstretched amorphous polyester fibers which become soft and sticky up to about 85° C., crystallize at higher temperatures without melting, and finally assume the thermal stability of a normal polyester fiber. While the fibers mentioned are temporarily sticky, granular activated charcoal with a size of 0.1 to 0.5 mm can again be affixed to them, among other things. This makes it possible to achieve complete coverage of the exposed fibers, as opposed to only point-by-point fixation of the activated charcoal on the upper and lower side of the textile surface structure, and thereby to achieve corresponding high adsorption performance with low flow-through resistance.

Finally, DE-A-1 279 917 describes a vapor hood with an adsorption filter made of a fiber-like material, where activated charcoal grains with a diameter of 0.5 to 1 mm are glued onto the fibers, which are coated with highly viscous paste. The fibers prepared in this way are held between air-permeable woven material, forming fiber mats, in the known vapor hood. Such a material could also be structured according to the teaching of the invention, in such a way that a gas mask filter with the required low pressure drop and high adsorption performance can be produced.

In the known textile structures, or those formed according to the invention, the distance between the threads, fibers, monofilaments or wires should be at least twice as great as the diameter of the activated charcoal particles used in each instance. Preferably, it is three to ten times as great. If the highly air-permeable surface structure consists of an open-pore foam layer, its pores should have a diameter of 1 to 5 mm, preferably 1.5 to 2.5 mm.

The known surface structures, or those which are possible for use according to the invention, generally have a thickness of a few millimeters, for example 1 to 5 mm. If they are composed of monofilaments, wires or threads, their diameter is preferably 0.1 to 0.8 mm.

The highly air-permeable surface structures can be flexible, but also can be rigid. When the granular, particularly spherical activated charcoal particles are affixed on them, and they are preferably completely covered with the activated charcoal particles, the rigidity increases, and the highly air-permeable surface structures are then relatively rigid, pressure-resistant structures; this holds true even more for the activated charcoal filter layer for gas masks composed of them.

Instead of forming the gas mask filter of surface filters superimposed on one another, with few or many layers being necessary for this, depending on their thickness and the thickness of the activated charcoal filter layer of the gas mask, it is also possible to subsequently cut the surface filters charged with activated charcoal beads or grains, to form elementary filters in the form of strips or chips, with a size of approximately a few square centimeters. This results in complete independence from the shape of the objects to be filled, and the elementary filters can be placed in the cavities to be filled, together with heterophilic fibers or threads of hot-melt glue. The entire assembly can be solidified after filling, so that even under great mechanical stress, there is no risk of settling or abrasion, as is the case in bulk filters.

Depending on the material of which the carrier framework is formed, the activated charcoal particles can be affixed to it directly, or an adhesive mass is required. Plastic materials, particularly fiber materials, are commercially available, which have the property of first becoming sticky on the surface at an elevated temperature, within a certain temperature interval, without melting. This property, which could be designated as a built-in hot-melt glue, can be utilized to affix the activated charcoal particles to them, as described in detail in DE-A-32 00 959.

Another possibility preferred for the purposes of the invention is to affix the activated charcoal particles to the carrier framework with an adhesive mass. With this alternative, a person skilled in the art has a greater choice with regard to the material of which the carrier framework is made, as well as with regard to the adhesive mass.

With both possibilities, the diameter of the wires, monofilaments or threads of the surface structure alone or with the adhesive mass is dimensioned in such a way that complete coverage with the activated charcoal particles is possible, in order to produce a filter element completely covered with the activated charcoal particles, in a preferred embodiment of the invention.

In order to fix the activated charcoal particles on the carrier, both inorganic and organic adhesive systems can be used. The latter include polymers, particularly acrylic acid derivatives, polyurethanes, polystyrenes, polyvinyl acetates as well as hot-melt glues. Those masses which consist of polymers which can be cross-linked, which pass through a viscosity minimum before being cross-linked, are preferred. Such adhesive systems, such as IMPRANIL ®-High-Solid-PUR reactive products from BAYER ® are highly viscous at first, i.e. they offer good initial adhesion when the carrier framework is being covered with the activated charcoal particles. With an increase in temperature, they demonstrate a great decrease in viscosity, which results in better wetting of the activated charcoal particles and therefore especially good adhesion after hardening, due to cross-linking. When the viscosity minimum is reached, small constrictions form at the contact sites between the carrier framework and the activated charcoal particles, due to capillary forces. Because the activated charcoal beads are practically attached at only one point, almost their entire surface is accessible to the gas to be cleaned after hardening. If the highly air-permeable surface structure consists of glass, metal or carbon fibers, adhesive masses of enamel or glazes can be used; in this case, the work has to be carried out in an inert atmosphere, due to the high temperatures required to melt these coatings, so that the effectiveness of the activated charcoal particles is not impaired or destroyed by oxidation.

The activated charcoal particles must be pourable and abrasion-resistant. It is most practical if their diameter is three to five times smaller than the diameter of the pores or openings of the highly air-permeable surface structure. Commercially available activated charcoal beads with a diameter of 0.1 to 1 mm are not only the most easily pourable form, but also withstand the greatest stress, due to their symmetry. Granular activated charcoal particles are also suitable, however, as long as they are not too angular or too irregular in their shape, because it is important that the activated charcoal particles can still penetrate into structures with a thickness of several centimeters when they are affixed on their surface structure.

Activated charcoal particles suitable for gas mask filters should have an internal surface of 600 to 2000 $m^2/g$, preferably 1000 to 1600 $m^2/g$ determined according to the BET method. The activated charcoal particles should be very pressure-resistant and preferably highly resistant to moisture. A very abrasion-resistant spherical activated charcoal can be produced, for example, of coal tar pitch or petroleum distillation residues. Additional hardening of the surface as well as noteworthy moisture resistance can be achieved with special post-treatment. The production of suitable activated charcoal beads is described, for example, in EP-B-118 618, DE-B-29 32 571 and DE-A-30 41 115.

In order to increase the abrasion resistance, the activated charcoal can also be impregnated at its surface in a plastic dispersion or a coal tar pitch solution or bitumen solution, and subjected to slight post-activation. The sensitivity with regard to steam can be significantly reduced by adding ammonia gas during post-activation and cooling to 100° C. with exclusion of air.

The activated charcoal particles can be impregnated with metal compounds, particularly compounds of the metals silver, copper and chromium. In addition, encapsulated enzymes which decompose poisons, such as those described in EP-B-118 618, can also be present.

With the filters described, excellent separation effects for pollutants and gases were achieved at extremely low pressure drops. It was surprisingly shown that it is not necessary for flow to go through the activated charcoal grains, but rather only past them, in order to achieve high effectiveness with a low pressure drop. The Brownian motion of the gas molecules is sufficient to achieve a high adsorption velocity. A loosened activated charcoal filter layer according to the invention has a greater volume than a bulk filter, with the same performance, but significantly lower flow-through resistance. The amount of activated charcoal, 100 g, which is usual for a gas mask today, can be contained in a volume of approximately 350 ml with the carrier structures according to the invention.

Because of the varied possibilities of structuring the filter material according to the invention, the shape of the gas mask filter can also be adapted to the most varied needs. For example, the filter can certainly be housed in a hood mask, e.g. around the head or at the neck, and then serves as additional head or neck protection against impacts. In this case, the filtered air should flow past the eyes, in order to prevent fogging of the visor window. A plate-shaped filter can be worn on the chest or back and connected with the mask element by way of a flexible hose. Cylindrical filter elements with a diameter of several centimeters can also be housed directly in a flexible hose, or be coupled together to form a hose, using suitable means. Such replaceable filter elements can also have various functions. It is most practical if the inlet opening of the hoses containing the filter elements or comprised of them is located on the inside of a protective suit.

It will be understood that the specification and examples are illustrative but not limitative of the present invention and that other embodiments within the spirit and scope of the invention will suggest themselves to those skilled in the art.

What is claimed is:

1. An activated charcoal filter layer for gas masks, comprising a stack of superimposed, highly air-permeable surface structures, each completely covered with a layer of granular or spherical activated charcoal particles with a diameter of 0.1 to 1 mm affixed to such structures, the surface structures having openings or pores of a diameter of about 1 to 5 mm, the surface structures being selected from the group consisting of a highly air-permeable foam layer, a fiber-like material, rubber hair and a woven, non-woven or plush textile, the filter layer having a pressure drop of less than 10 mm water column at a thickness of 4 cm with a circular cross-section of 100 $cm^2$ at an air flow of 1 l/sec.

2. A filter layer according to claim 1, wherein the surface structures are a highly air-permeable foam layer.

3. A filter layer according to claim 1, wherein the surface structures are a fiber-like material or rubber hair.

4. A filter layer according to claim 1, wherein the surface structures are a textile surface structures.

5. A filter layer according to claim 4, wherein the textile surface structures are a nonwoven textile.

6. A filter layer according to claim 4, wherein the textile surface structures are a woven or plush textile.

7. A filter layer according to claim 4, wherein the textile surface structures contain fibers which temporarily become sticky at elevated temperatures, without melting.

8. A filter layer according to claim 7, wherein the fibers are heterophilic fibers of two coaxially arranged components, the outer one of which has a lower melting point.

9. A filter layer according to claim 7, wherein the fibers are unstretched amorphous polyester fibers which become soft and sticky up to about 85° C.

10. A filter layer according to claim 1, wherein the activated charcoal particles are affixed on the surface structures with an adhesive mass.

11. A filter layer according to claim 10, wherein the adhesive mass comprises a polymer of an acrylic acid derivative, polyurethane, polystyrene, polyvinyl acetate or hot-melt glue.

12. A filter layer according to claim 10, wherein the adhesive mass consists of a polymer which can be cross-linked and which passes through a viscosity minimum before being cross-linked.

13. A filter layer according to claim 1, having 50 to 300 g activated charcoal per liter.

14. A filter layer according to claim 1, wherein the activated charcoal particles are pressure-resistant and moisture resistant.

15. A filter layer according to claim 1, wherein the activated charcoal particles are impregnated with a metal compound.

16. A filter layer according to claim 1, wherein the activated charcoal particles are impregnated with a compound of silver, copper or chromium.

17. A filter layer according to claim 1, additionally carrying an encapsulated enzyme.

18. A filter layer according to claim 1, having a pressure drop of less than 2 mm water column.

19. A hood gas mask comprising a hood and a charcoal filter layer comprising a stack of superimposed, highly air-permeable surface structures, each completely covered with a layer of granular or spherical activated charcoal particles with a diameter of 0.1 to 1 mm affixed to such structures, the surface structures having openings or pores of a diameter of about 1 to 5 mm, the surface structures being selected from the group consisting of a highly air-permeable foam layer, a fiber-like material, rubber hair and a woven, nonwoven or plush textile, the filter layer having a pressure drop of less than 10 mm water column at a thickness of 4 cm with a circular cross-section of 100 $cm^2$ at an air flow of 1 l/sec.

20. A hood gas mask according to claim 19, wherein the filter layer is formed as a head or neck protection.

21. A hood gas mask according to claim 19, comprising a plurality of the filter layers arranged to form a hose.

22. A gas mask including a filter layer formed in the shape of a plate, so that it can be worn on the chest or back, the filter layer being connected with the mask element by way of a flexible hose, said filter layer being an activated charcoal filter layer comprising a stack of superimposed, highly air-permeable surface structures, each completely covered with a layer of granular or spherical activated charcoal particles with a diameter of 0.1 to 1 mm affixed to such structures, the surface structures having openings or pores of a diameter of about 1 to 5 mm, the surface structures being selected from the group consisting of a highly air-permeable foam layer, a fiber-like material, rubber hair and a woven, nonwoven or plush textile, the filter layer having a pressure drop of less than 10 mm water column at a thickness of 4 cm with a circular cross-section of 100 cm at an air flow of 1 l/sec.

* * * * *